US005444997A

United States Patent [19]

Turner et al.

[11] Patent Number: 5,444,997

[45] Date of Patent: Aug. 29, 1995

[54] CARRIER FOR SUPPORTING TEXTILE MATERIAL IN A WET TREATMENT MACHINE

[75] Inventors: J. Keith Turner; Matthew A. Meeker; Thomas W. Van Scyoc, all of Stanley, N.C.

[73] Assignee: Gaston County Dyeing Machine Company, Stanley, N.C.

[21] Appl. No.: 218,573

[22] Filed: Mar. 28, 1994

Related U.S. Application Data

[63] Continuation-in-part of Ser. No. 8/134,912, Oct. 12, 1993, and a continuation-in-part of Ser. No. 8,049,835, Apr. 19, 1993.

[51] Int. Cl.[6] ..... D06B 5/18

[52] U.S. Cl. ..... 68/198; 68/175; 68/181 R; 68/208

[58] Field of Search ..... 68/175, 181 R, 187, 68/188, 189, 194, 198, 208, 199; 137/576, 577

[56] References Cited

U.S. PATENT DOCUMENTS

| | | | |
|---|---|---|---|
| 632,317 | 9/1899 | Middleton et al. | 68/199 |
| 2,302,326 | 11/1942 | Kehoe et al. | 137/576 X |
| 2,562,220 | 7/1951 | Stienen . | |
| 2,713,347 | 7/1955 | Hazy | 68/208 X |
| 3,438,071 | 4/1969 | Clark | 68/175 X |
| 3,596,481 | 8/1971 | Wilcox . | |
| 4,452,055 | 6/1984 | Lejeune et al. . | |
| 4,825,668 | 5/1989 | Villard et al. . | |
| 4,884,418 | 12/1989 | Barriquand et al. . | |
| 5,172,443 | 12/1992 | Christ . | |

FOREIGN PATENT DOCUMENTS

| | | | |
|---|---|---|---|
| 29708 | 8/1907 | Austria | 68/189 |
| 0110058 | 1/1987 | European Pat. Off. . | |
| 465628 | 9/1928 | Germany | 68/189 |
| 1018580 | 1/1966 | United Kingdom . | |
| 2062036 | 5/1981 | United Kingdom . | |

*Primary Examiner*—Philip R. Coe
*Attorney, Agent, or Firm*—Shefte, Pinckney & Sawyer

[57] ABSTRACT

Textile yarn package supporting carriers are disclosed for use in textile dyeing machines to enable the machine to be effectively operated at less than full capacity. Each carrier has a base with multiple upstanding package supporting posts equipped with interchangeable adapters to accommodate differing numbers of yarn packages up to the maximum capacity of the carrier. An upstanding wall on the base defines an enclosure for retaining treating liquid, and the wall has a selectively movable and removable panel for forming a liquid weir at a selectively variable level relative to the base to determine a maximum level of liquid which may be retained in the carrier enclosure.

22 Claims, 8 Drawing Sheets

CARRIER FOR SUPPORTING TEXTILE MATERIAL IN A WET TREATMENT MACHINE

CROSS REFERENCE TO RELATED APPLICATION

This is a continuation-in-part of co-pending U.S. patent application Ser. No. 08/134,912, filed Oct. 12, 1993, entitled CARRIER FOR SUPPORTING TEXTILE MATERIAL IN A WET TREATMENT MACHINE, and a continuation-in-part of co-pending U.S. patent application Ser. No. 08/049,835, filed Apr. 19, 1993, entitled HORIZONTAL WET TREATMENT MACHINE FOR TEXTILES AND TEXTILE MATERIAL CARRIERS THEREFOR.

BACKGROUND OF THE INVENTION

The present invention relates generally to textile wet treatment machines and more particularly to a carrier for supporting packages of textile material during processing in a wet treatment machine such as, for example, textile yarn package dyeing machines.

Textile package dyeing machines normally have a cylindrical pressurizable vessel into which packages of textile material to be wet processed, e.g., yarn packages wound on cylindrical spools, are arranged in vertical stacks on supporting vertical tubes arranged in spaced relation over the interior of the dye vessel. Such dyeing machines basically are of two types, commonly referred to as vertical dyeing machines, i.e., wherein the cylindrical vessel is oriented vertically with an openable lid at the upper end of the vessel for vertical insertion and removal of yarn packages to be dyed, and horizontal dyeing machines, wherein the cylindrical vessel is oriented horizontally with an openable lid at one end for horizontal insertion and removal of yarn packages to be dyed.

In both horizontal and vertical dyeing machines, it is conventional practice to support the yarn packages on a removable carrier which, in the case of vertical machines, can be lifted and lowered and, in the case of horizontal machines, can be horizontally transported on tracks or conveyors, for inserting and removing the yarn packages into and from the dye vessel. Conventional carriers of this type basically comprise a base with a plurality of upstanding tubes mounted in a spaced arrangement to the base. Yarn packages are slidably mounted over the upper ends of the tubes in a stacked arrangement and are secured by a cap threaded onto a compatibly threaded upper end portion of each tube. The upstanding tubes are hollow and perforated and communicate with concentric openings formed through the base to permit dye liquor to flow axially through the tubes and radially through the yarn packages.

While such carriers function satisfactorily and advantageously when supporting a full capacity of yarn packages, difficulties are encountered in dyeing smaller lots of yarn packages which do not require each tube to be fully stacked with yarn packages. In such cases, it is highly undesirable to fill the dye vessel with dye liquor to the same volume utilized when dyeing a full capacity of yarn packages. Accordingly, the volume of the dye bath is reduced commensurate with the number of yarn packages actually being dyed.

SUMMARY OF THE INVENTION

It is accordingly an object of the present invention to provide an effective means by which the level of the dye bath within a textile machine for wet treatment of yarn and like textile packages can be easily regulated in correspondence to the number of packages in the carrier. A more particular object of the invention is to provide an improved package carrier for use in wet treatment machines which enables diverse numbers of textile yarn and like material packages to be selectively supported during wet processing operations.

Basically, the present invention contemplates the provision of a selectively movable and removable panel in a liquid-containment wall structure disposed within the vessel of a textile wet treatment machine. Selective placement or removal of the panel enables the formation of a liquid weir at a selectively variable level to determine a maximum level of liquid which may be retained in the enclosure. The wall structure to which the panel is mountable may be part of a yarn package carrier insertable into the vessel of the wet treatment machine or, alternatively, may be mounted permanently within the vessel of the wet treatment machine, so long as the wall structure serves the purpose of defining an enclosure for retaining a quantity of treating liquid within which textile material packages are to be disposed during wet treatment operations.

For example, a package carrier according to the present invention basically includes a base, a wall structure upstanding from the base and defining therewith an enclosure for retaining treating liquid, and one or more post assemblies extending outwardly from the base for mounting a plurality of the textile material packages in series about each post. According to the present invention, the wall structure comprises a selectively movable panel for forming a liquid weir at a selectively variable level relative to the base. In this manner, the disposition of the weir panel determines a selectively variable maximum level of liquid which may be retained in the enclosure.

Preferably, the wall structure of the carrier defines an opening through the wall into the liquid enclosure and matable mounting elements are provided along opposite lateral sides of the panel and also along opposite lateral sides of the opening for mounting of the panel at varying dispositions wherein the opening is covered to selectively varying extents. In the preferred embodiment, the engaging elements of the panel are of a wedge shape and the engaging elements on the wall structure comprise brackets tapered in conformity to the wedge shape of the panel elements. The respective mounting elements on the panel and on the wall structure enable the panel to be selectively positioned as well as to be selectively removed from the wall structure.

Since the lesser volume of the dye bath will result in the level of the bath being below the upper end of the package-supporting post assemblies, appropriate measures must be taken to prevent dye liquor flow along the full height of the post assemblies. In the conventional use of perforated package supporting tubes as above described, this is accomplished in one of two manners, either by placing a tubular cover over the exposed length of each perforated tube to block the perforations in the tube or by situating one or more volumetric displacement elements within the carrier or otherwise within the dye vessel to raise the level of the lesser volume of dye liquor to the level occupied during full capacity dyeing. Disadvantageously, however, volumetric displacers increase the risks of potential contamination of the dye liquor, while the tubular covers may not fully seal the exposed perforations in the package-supporting tubes, thereby risking the possibility that air may be drawn into the pump of the dyeing machine used for circulating the dye liquor.

In contrast, in the present invention, each post has a longitudinal package supporting portion adjacent the base and a longitudinal spindle portion extending outwardly from and in alignment with the package supporting portion. The package supporting portion of each post is of predetermined lengthwise and transverse dimensions for centrally supporting a predetermined minimum number of the annular textile material packages securely on the post. A package supporting adapter is provided for mounting to and demounting from the spindle portion of each post at a position therealong in longitudinal adjacency to the package supporting portion of the post, the adapter being of predetermined lengthwise and transverse dimensions for centrally supporting a predetermined number of the annular textile material packages securely on each post in addition to the predetermined minimum number supported by the package supporting portion of the post. A package retaining cap is mountable to and demountable from the spindle portion of each post for selective disposition at differing package retaining positions therealong in engagement with the outermost one of the textile packages supported on the post.

Preferably, a set of several adapters of differing lengths are provided for each post to enable selective alternative mounting of differing adapters on the spindle portions of the posts for supporting thereon differing pluralities of textile material packages. Thus, by the selective use of an appropriate one of the adapters on each post, or the selective non-use of adapters on the posts, the package supporting capacity of the carrier can be readily varied, in turn enabling a corresponding reduction to be achieved in the required volume of processing liquid in the wet treatment machine without risk of contamination or risk of drawing air into the pump of the machine.

Preferably, the base of the carrier includes a liquid flow opening for each post and each post includes an annular mounting portion affixed to the base about the liquid flow opening for liquid communication therethrough with the annular interior of the textile packages supported on the posts.

The package supporting portion of each post is configured to permit liquid flow axially through the annular interior of the textile packages. For example, each package supporting portion may comprise a plurality of radially outwardly extending package supporting struts. Likewise, the package supporting adapters similarly permit liquid flow axially through the textile packages. For this purpose, each adapter preferably has a sleeve for slidable mounting to and demounting from the spindle portion of a post, with plural radially outwardly extending package supporting struts being affixed to the sleeve.

The package retaining cap is mounted to the spindle portion of its respective post for lengthwise movement therealong, preferably by providing the spindle portion and the package retaining cap with compatible screw threads.

Carriers in accordance with the present invention may be appropriately configured in differing embodiments for use in either horizontal-type wet treatment machines or vertical-type wet treatment machines.

DESCRIPTION OF THE PREFERRED EMBODIMENT

Figure 1:
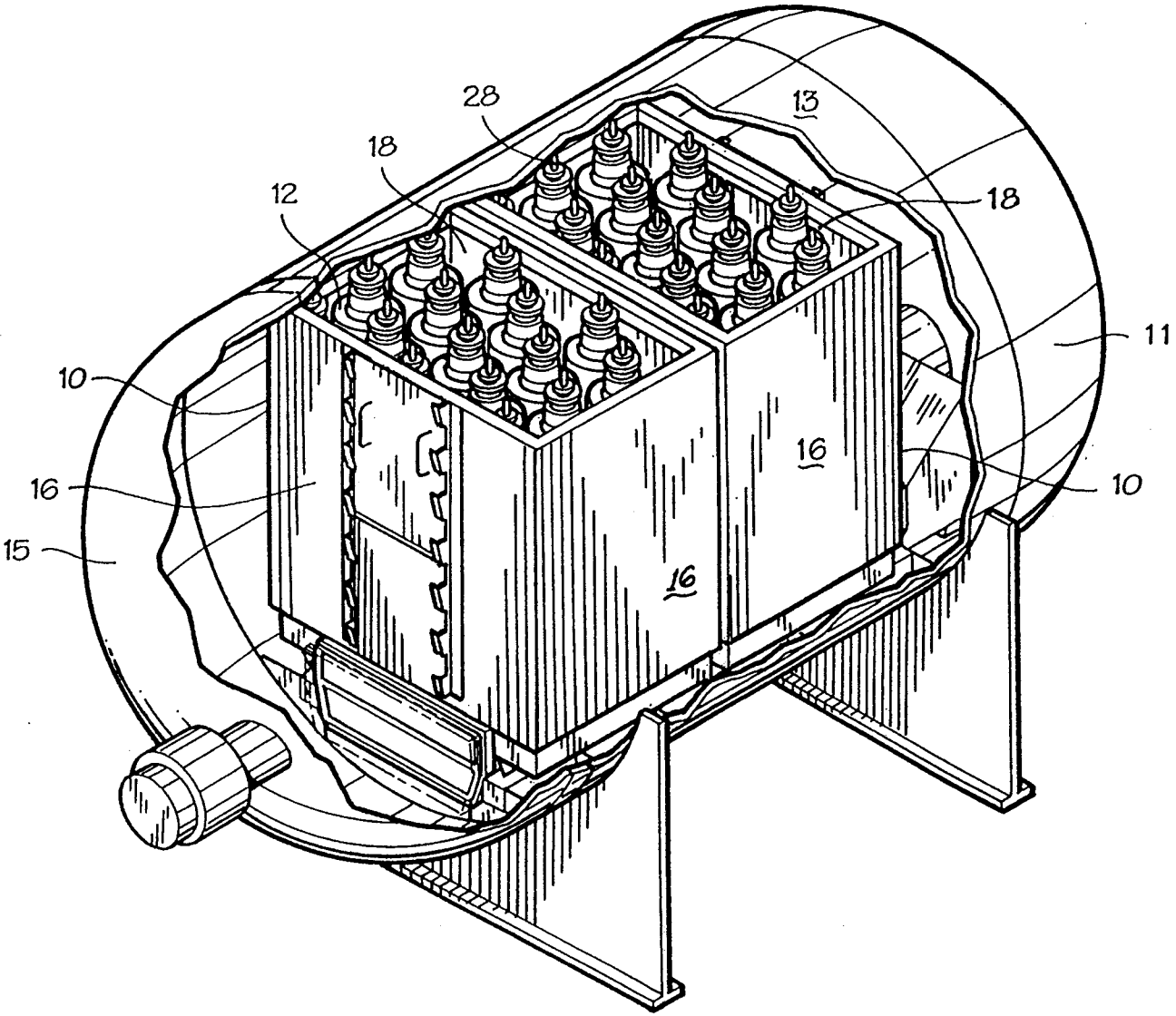
FIG. 1 is a perspective view of a horizontal yarn package dyeing machine with its vessel partially broken away to show two of the yarn package carriers according to the preferred embodiment of the present invention.

Referring now to the accompanying drawings and initially to FIG. 1, a typical representative horizontal-type textile yarn package wet processing machine 11, e.g., a yarn dyeing machine, is shown with its outer vessel or housing 13 broken away to illustrate the disposition therein of two yarn package carriers 10 according to a preferred embodiment of the present invention. One end of the vessel 13 is hinged to the main body of the vessel 13 to serve as a lid or cover 15 for opening to load and unload carriers 10 into the machine 11. The carriers 10 are adapted for supporting textile material in the form of yarn packages 12 for independent transport to and from the dyeing or other horizontal type textile wet treatment machine 11 by means of a conventional carrier transport assembly (not shown), preferably an arrangement of one or more conveyor belts and/or tracks, for transporting each carrier 10 to and from the dyeing machine, which may be located in an arrangement of multiple dyeing machines commonly served by the same carrier transport assembly. As illustrated, each carrier 10 is loaded with the yarn packages 12 to less than full capacity in accordance with the present invention, as more fully described hereinafter.

Figure 2:
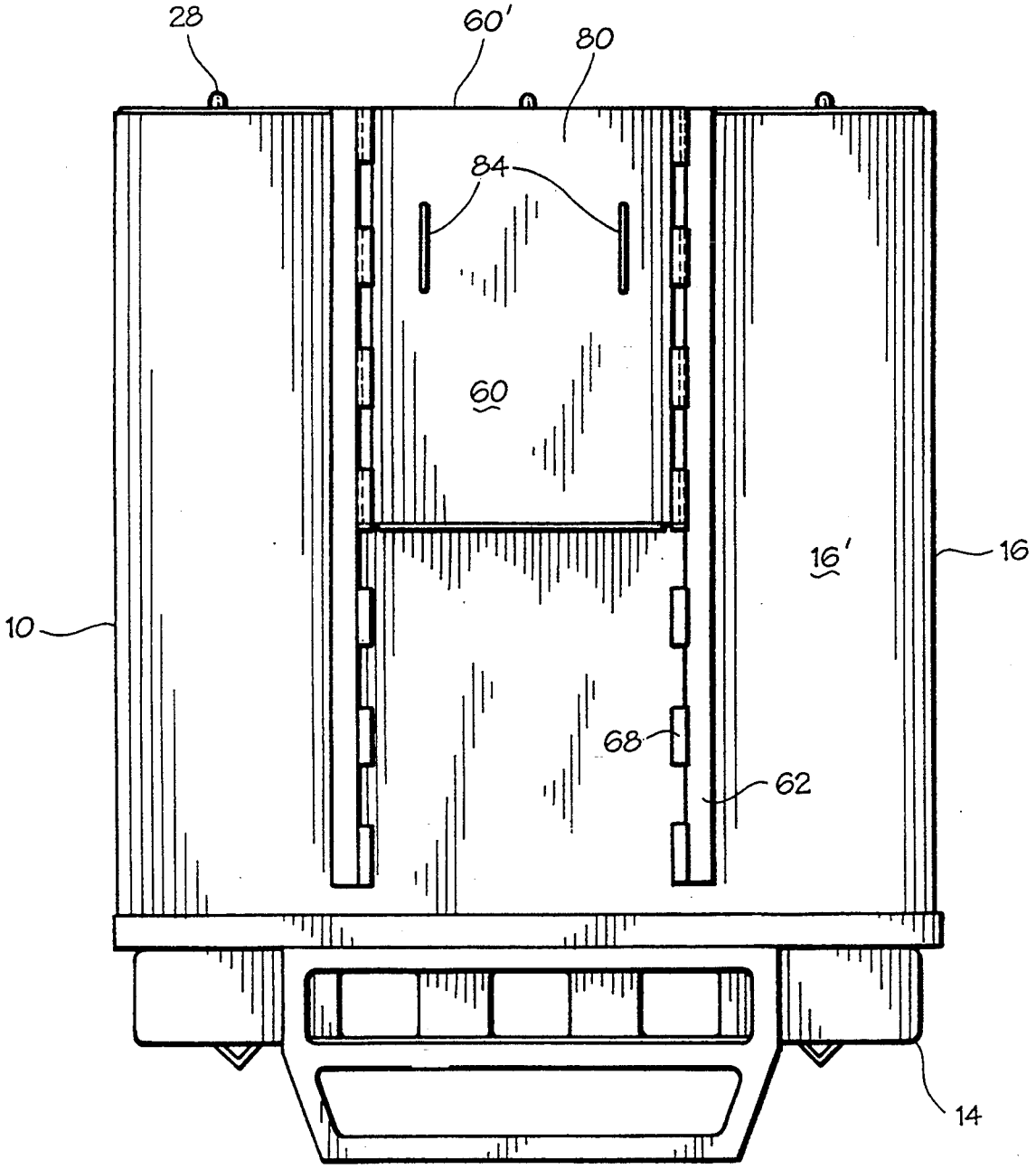
FIG. 2 is an end elevational view of one of the carriers illustrated in FIG. 1, showing the movable wall panel of the present invention.
Figure 3:
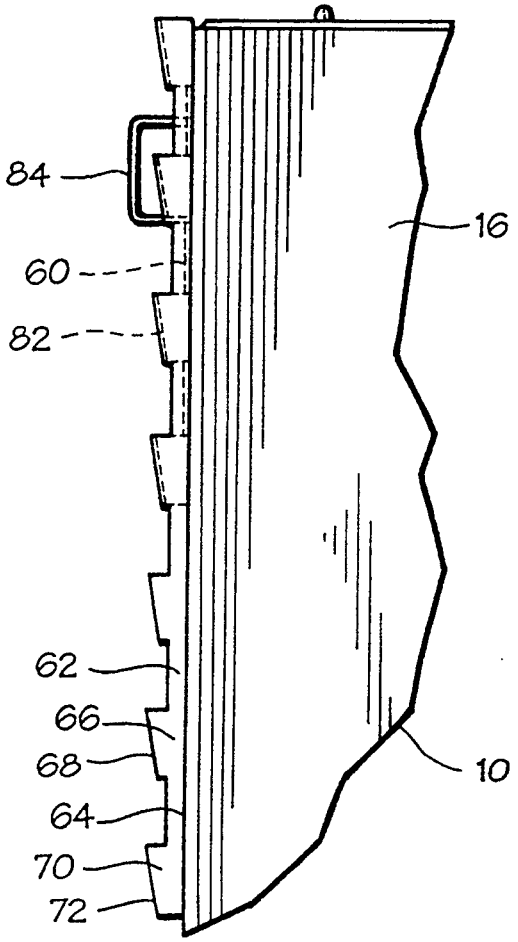
FIG. 3 is a partial side elevational view of the carrier of FIG. 2, taken at the end thereof depicted in FIG. 2.
Figure 5:
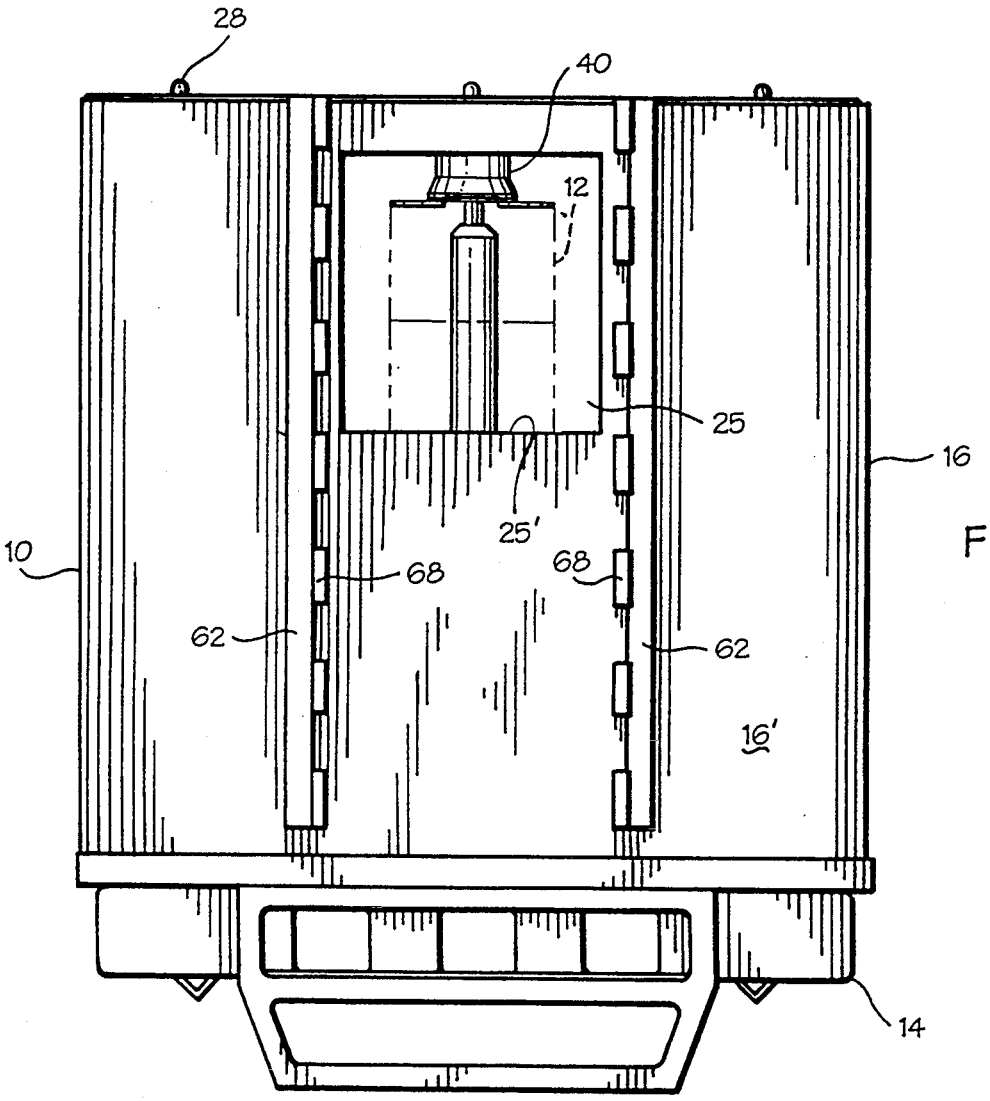
FIG. 5 is an end elevational view of the carrier of FIG. 2, with the wall panel removed.
Figure 6:
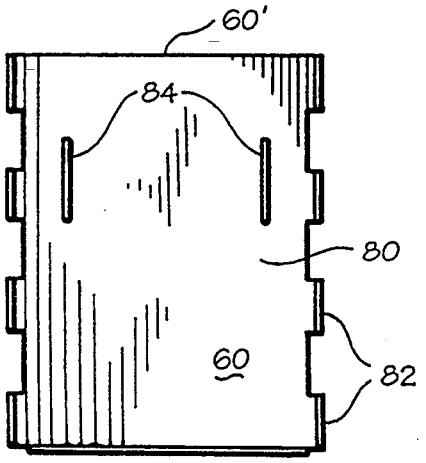
FIG. 6 is an elevational view of the wall panel of the present carrier.
Figure 7:
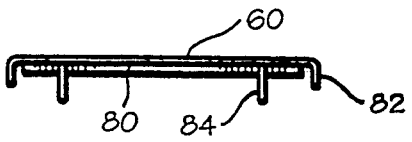
FIG. 7 is a top plan view of the wall panel of FIG. 6.

With additional reference to FIGS. 2 and 5, each carrier 10 basically includes a base structure 14 which serves both to support the yarn packages 12 and as a liquid flow assembly for delivery and withdrawal of treating liquid, e.g., a dye liquor, bleaching solution, water wash, or other appropriate treating fluid, to and through the carrier 10. The base structure 14 is preferably rectangular in overall horizontal cross-section. An upstanding wall 16 having four substantially flat planar sides is affixed to the base structure 14 to extend upwardly from its periphery and thereby forms with the base structure 14 an enclosure 18 for retaining the treating liquid during wet treatment of the yarn packages 12 therein. The top of the carrier's enclosure 18 is open for ease of loading thereinto and unloading therefrom the yarn packages 12.

As more fully described in parent application Ser. No. 08/049,835, the entirety of which is incorporated herein by reference, the liquid flow arrangement formed by the base structure 14 includes two liquid distribution chambers 20,22 (see FIGS. 10–12) formed within the base structure 14 and communicating with the enclosure 18 defined by the base structure 14 and the wall 16, one of the liquid distribution chambers 20,22 serving to deliver treating liquid into the enclosure 18 and the other serving to withdraw treating liquid from the enclosure. Each of the chambers 20,22 extends through substantially the full horizontal extent of the base structure 14 with the chamber 20 disposed above the chamber 22. The upper chamber 20 communicates with the enclosure 18 through openings 24 formed in the top of the base structure 14, while the lower chamber 22 communicates with the enclosure 18 through elongated passages 26 which extend from the lower chamber 22 upwardly through the upper chamber 20.

Each chamber 20,22 of each carrier 10 has end openings 20', 22' (FIGS. 2 and 5) at each opposite end of the base structure 14 for communicating with corresponding openings of the chambers of the adjacent carrier 10 disposed in the vessel of the wet treatment machine or, alternatively, with ports of a duct assembly formed in the machine for supplying liquid to and withdrawing liquid from the interior of the machine in a conventional manner.

Of course, those persons skilled in the art will recognize and understand that other forms of base structures and liquid flow arrangements may be utilized in carriers embodying the present invention and, accordingly, it is to be understood that the present invention is not limited to the described carrier base structure or liquid flow arrangement.

The carrier 10 is equipped with a plurality of upstanding post assemblies 28, as shown in FIG. 1, which are mounted to and extend upwardly from the base structure 14 for the purpose of supporting and retaining on each post assembly 28 a stacked column of multiple yarn packages 12. The post assemblies 28 are arranged in longitudinally extending rows spaced sufficiently from one another both longitudinally and transversely within the carrier enclosure 18 to permit non-interfering vertical stacking of the packages 12 thereon.

The particular post assemblies 28 illustrated and described herein are more fully disclosed in parent application Ser. No. 08/134,912, the entirety of which is incorporated herein by reference, but those persons skilled in the art will recognize and understand that other forms of post assemblies may also be utilized without departing from the substance of the present invention and, accordingly, the present invention is not to be limited to the described post assemblies 28.

Figure 4:
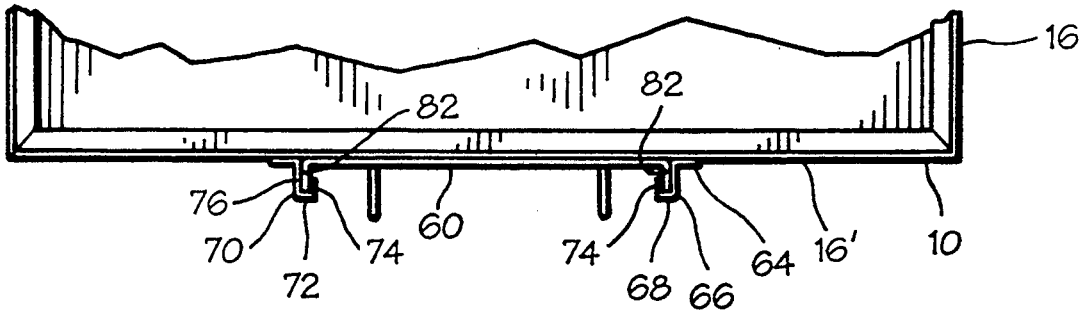
FIG. 4 is a partial top plan view of the carrier of FIG. 2, taken at the end thereof depicted in FIG. 2.
Figure 10:
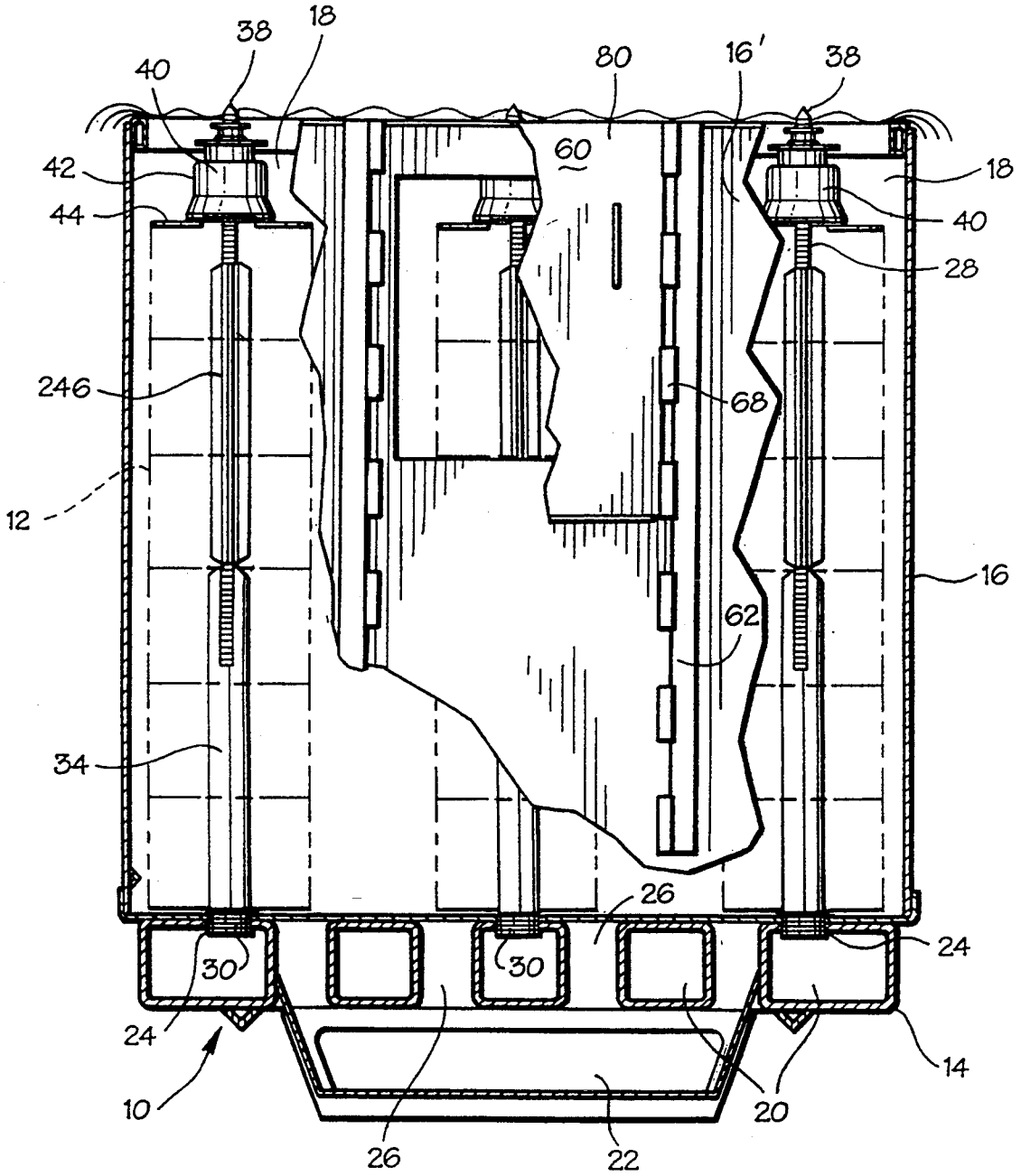
FIG. 10 is an end elevational view of the carrier of FIG. 2, with the wall panel positioned to fully cover the opening in the carrier wall and with the carrier wall partially broken away to show the arrangement of textile yarn packages within the carrier when filled to its maximum capacity with yarn packages.
Figure 11:
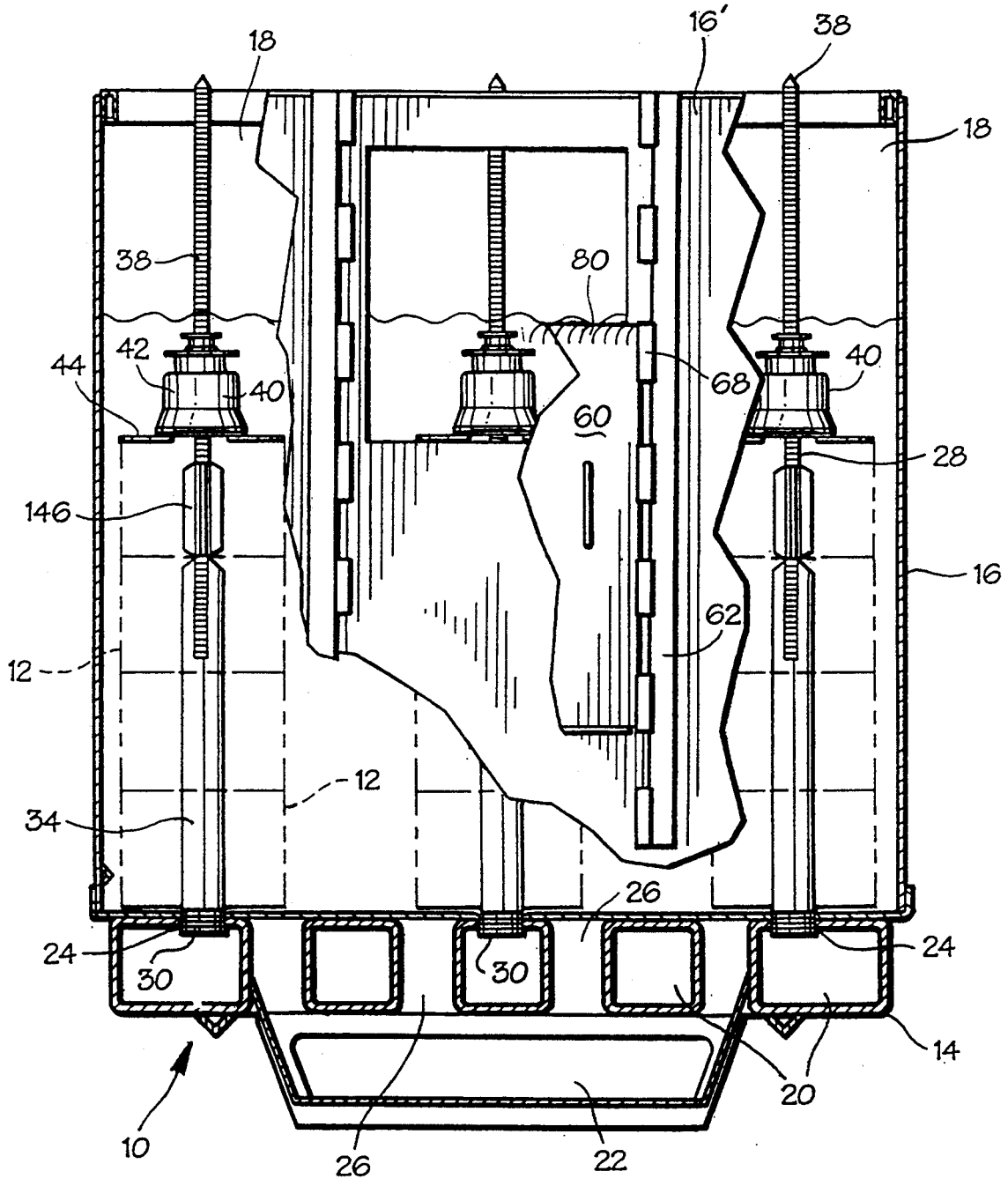
FIG. 11 is an end elevational view, similar to FIG. 10, but with the carrier filled to a lesser capacity with yarn packages and with the wall panel positioned at a lower level in correspondence with the quantity of yarn packages therein.
Figure 12:
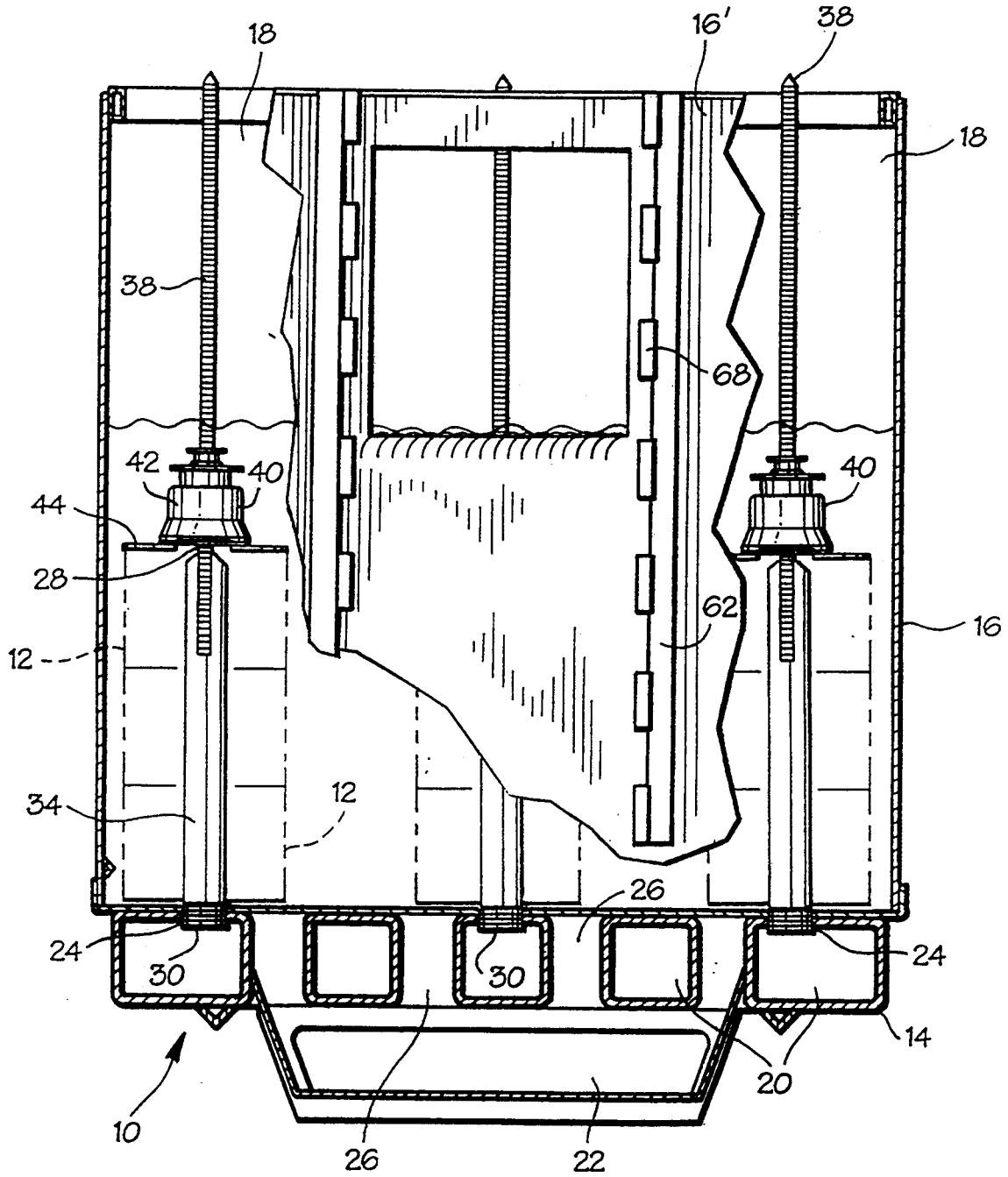
FIG. 12 is another end elevational view, similarly to FIGS. 10 and 11, with the carrier filled to its minimum capacity with yarn packages and with the wall panel accordingly removed from the carrier.

Each post assembly 28 is mounted to the base structure 14 in a manner permitting liquid communication between the liquid flow assembly of the base structure 14 and the annular interior of the yarn packages 12. For this purpose, each post assembly 28 is constructed as shown in FIGS. 10–12 with a lower tubular mounting portion 30 having external threads 32 and each liquid opening 24 in the top of the base structure 14 is correspondingly threaded internally for threaded mounting of each post assembly 28 coaxially within a respective liquid opening 24 in the base structure 14 for communication through the tubular mounting portion 30 with the liquid distribution chamber 20. Each post assembly 28 has an elongate package supporting portion 34 formed by three lengthwise struts 36 projecting radially outwardly from one another at equal angular spacings and affixed at one end co-axially to the upper annular edge of the mounting portion 30 of the respective post assembly 28, as best seen in FIG. 4. An elongated threaded spindle rod 30 is rigidly affixed centrally to the struts 36 at the upper end of the package supporting portion 34 of each post assembly 28 in co-axial alignment with the tubular mounting portion 30.

The radially transverse dimension of the struts 36 of the package supporting portion 34 are selected to correspond to the inside diameter of a textile yarn package 12 so that a package placed about the package supporting portion 34 of any post assembly 28 will be securely supported by the struts 36 against undesirable lateral movement relative to the post assembly 28. Similarly, the lengthwise dimension of the package supporting portion 34 is selected to correspond to the stacked dimension of a certain number of the packages 12 which has been predetermined to be the minimum number of packages to be supported on each post assembly 28 during any dyeing operation. By way of example, the lengthwise dimension of the struts 36 in the illustrated embodiment is sufficient for laterally supporting a column of three stacked yarn packages 12 on each post assembly 28, although those persons skilled in the art will readily recognize that the package supporting portion 34 may be of any other selected longitudinal dimension as may be desirable.

Each post assembly 28 is provided with a packaging retaining cap 40 having an annular main body 42 defining a central bore (not shown) therethrough threaded correspondingly to the spindle rod 38 and a laterally extending flange plate 44 affixed to the lower side of the cap 40. In this manner, once a stack of yarn packages 12 are placed on each post assembly 28, the package retaining cap 40 for the post assembly may be threadedly mounted on the spindle rod 38 and advanced therealong into retaining engagement with the uppermost package supported on the post assembly (see FIGS. 10–12). Of course, other conventional forms of caps may alternatively be used.

To facilitate mounting of additional yarn packages 12 on each post assembly 28, up to the predetermined maximum package capacity for the carrier 10, each post assembly 28 is provided with a set of package supporting adapters 46, two of which are representatively shown in FIGS. 10 and 11, for selective placement on the spindle rod 38 of the post assembly 28 to effectively extend the length of the package supporting portion 34. Each adapter 46 has a central elongate cylindrical tubular body 48 to which four plate-like struts 50 are affixed at equal radial spacings axially along the full length of the tubular body 48 and projecting radially outwardly therefrom to substantially the same overall transverse dimension as the package supporting portion 34. The individual adapters 46 of each set are of varying axial lengths selected in relation to the axial dimension of the yarn packages 12. For example, the adapter 146 of FIG. 11 has an axial length corresponding to that of a single yarn package 12 and the adapter 246 of FIG. 10 has an axial length corresponding to that of three stacked yarn packages 12. Another adapter (not shown) would of course be provided, with an axial length corresponding to that of two stacked yarn packages 12, to provide the flexibility to load the carrier to any desired capacity.

Thus, as will be seen in FIG. 10, when it is desired to load the carrier 10 to its maximum capacity with yarn packages 12, each post assembly 28 is fitted with its associated adapter 246 with its tubular main body 48 slidably disposed about the spindle rod 38 to rest in axial adjacency on the upward ends of the struts 36 of the package supporting portion 34. In this manner, the effective length of the package supporting portion 34 is extended by the adapter 46 to enable the post assembly 28 to securely support laterally a column of six stacked yarn packages 12, the struts 36 of the package supporting portion 34 supporting the lower three packages in the stack and the struts 50 of the adapter 346 supporting the upper three packages of the stack. The cap 40 is threaded onto the upper end of the spindle rod 38 into retaining engagement with the uppermost package 12 in the column of six packages.

Alternatively, for example, when it is desired to place only four packages 12 in a stacked column on each post assembly 28, the adapter 146 is utilized, as depicted in FIG. 11. No adapter is used when the minimum of three packages 12 is placed on each post assembly 28, as depicted in FIG. 12.

Of course, those persons skilled in the art should readily understand and recognize that the embodiment shown in the drawings is merely by way of illustration and example. The post assembly 28 may be of any desired length to handle any desired maximum number of yarn packages. It is also contemplated that the adapters 46 could be utilized in combination rather than alternatively. For example, a series of two or more of the adapters 146 could be utilized as necessary to support yarn packages in excess of the minimum number accommodated by the package supporting portion 34. Further, the spindle rod 38 could extend the entire length of the post assembly 28 without any fixed package supporting portion 34, with adapters 46 being utilized to support stacked yarn packages.

With the post assemblies 28, including any adapter 46 which may be utilized, the carrier 10 may be placed in a conventional horizontal-type textile package dyeing machine and wet processing treatment of the yarn packages 12 will proceed in essentially conventional fashion. Specifically, the treating liquid is permitted to flow freely between the upper liquid distribution chamber 20 and the axial interior area of the stacked columns of yarn packages by passing through the tubular mounting portions 30 of the post assemblies 28 and traveling along the post assemblies 28 between the struts 36 of the package supporting portion 34 and, as applicable, the struts 50 of any adapter 46. Depending upon the direction of treating liquid circulation determined by the delivery and withdrawal of the treating liquid through the liquid distribution chambers 20,22, the treating liquid passes between the enclosure 18 and the annular interiors of the stacked package columns in either a radially inward or a radially outward direction. In either case, the progressive ongoing radial flow of the treating liquid through the packages 12 over the course of operation of the machine achieves the desired treatment of the yarn wound on the packages 12. The level of the treating liquid bath within the enclosure 18 can be reduced to the elevation of the cap directly above the stacked yarn packages to submerge the cap and thereby substantially prevent air within the enclosure 18 above the package columns from entering the annular interior area of the stacked package columns.

To facilitate such reduction of the liquid level within the carrier 10, the side wall 16 defining the enclosure 18 may be equipped with one or more removable or movable panels by which the upper edge of the wall 16 may be effectively lowered at least one side of the carrier 10 or, alternatively, the side wall 16 could be replaceable in its entirety with another side wall of lesser height.

For example, as depicted in FIGS. 1 and 2, one end wall 16' of each carrier 10 may be formed with a square or rectangular opening 25 extending from adjacent the upper edge of the wall 16 to a point at which the lower horizontal edge 25' of the opening 25 corresponds to the desired liquid level to be contained within the enclosure of the carrier 10 when it is occupied by the minimum of three yarn packages per post assembly 28. A wall panel 60, correspondingly square or rectangular in shape but slightly larger in lateral dimensions than the rectangular opening 25, is provided for selective mounting to the end wall 16' in partial or full covering relation to the opening 25, to serve as a variably positionable weir by which the level of wet processing liquid capable of being contained within the enclosure 18 of the carrier 10 may be selectively varied, as more fully described hereinafter.

For purposes of mounting the panel 60 to the end wall 16' of the carrier 10, a pair of mounting members 62 are affixed vertically to the outside surface of the end wall 16' along the opposite lateral sides of the opening 25 and extending downwardly therefrom in spaced parallel facing relation. As seen in FIGS. 2–5 and 8, each mounting member 62 has a base flange 64 extending the length of the mounting member 62, by which it is affixed rigidly, e.g., by welding or the like, to the outer surface of the end wall 16' in substantially parallel abutment therewith. A support flange 66 extends from the inner margin of each base flange 64 adjacent the opening 25 outwardly from the end wall 16' in substantially perpendicular relation thereto. A plurality of panel-retaining ears 68 extend from each support flange 66 at regular spacings along the length thereof so that the retaining ears of the mounting members 62 are arranged in opposed horizontally-facing relation to one another.

Figure 8:
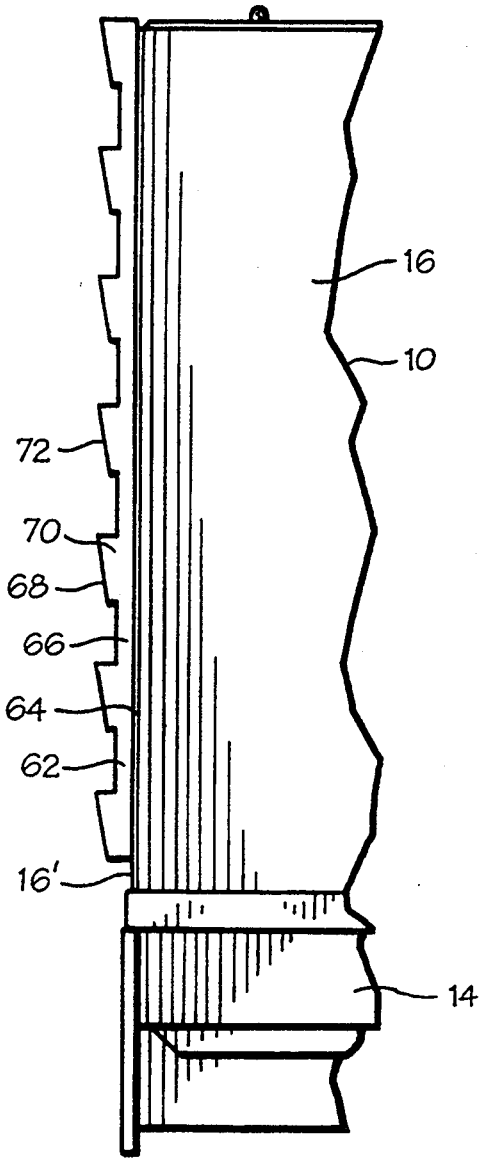
FIG. 8 is a partial side elevational view of the carrier of FIG. 2, similar to FIG. 3, but with the wall panel removed.
Figure 9:
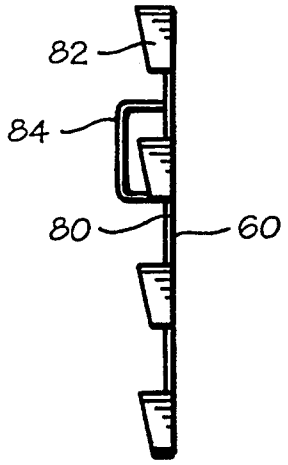
FIG. 9 is a side elevational view of the wall panel of FIGS. 6 and 7.

As best seen in FIGS. 4 and 8, each retaining ear is essentially U-shaped in horizontal cross-section (FIG. 4), with a trapezoidal base portion 70 extending outwardly from the respective support flange 66 co-planarly therewith, the upper and lower horizontal edges of the trapezoidal base portion 70 being parallel to one another but with the lower edge of a shorter length than the upper edge, a flat outer engagement portion 72 extending angularly in correspondence to the trapezoidal shape of the base portion 70 and in perpendicular relation thereto, and an inner marginal retaining portion 74 extending substantially parallel to the trapezoidal base portion 70. As will thus be seen, each retaining ear 68 essentially defines a downwardly tapering retaining channel 76 within the confines of the ear portions 70,72,74.

The weir panel 60 has a substantially flat planar main body 80 with a plurality of wedge-like tabs 82 projecting perpendicularly outwardly from the main body 80 at spacings along the opposite vertical side edges thereof corresponding to the spacings of the retaining ears 68 of the mounting members 62 on the carrier end wall 16'. Each wedge-like tab 82 is of a trapezoidal configuration substantially corresponding in shape and dimensions to the channels 76 defined by the retaining ears 68. A pair of handles 84 project outwardly from the face of the main panel body 80. In this manner, the panel 60 may be selectively mounted to the end wall 16' of the carrier 10 at any desired elevation therealong by placing the panel 60 in abutting relation against the outer face of the end wall 16' between the mounting members 62 with the tabs 82 inserted in the spacings between the retaining ears 68, and then moving the panel 60 downwardly to engage the tabs 82 at the opposite sides of the panel 60 securely into the channels 76 of the respective retaining ears 68 immediately below the tabs 82. The tabs 82 thusly seat in a secure wedge-like fashion within the channels 76 to hold the panel 60 firmly in place.

As will be understood, the disposition of the panel 60 on the carrier end wall 16' will be determined by the capacity to which the carrier 10 is loaded with yarn packages. As depicted in FIGS. 2 and 10, when the carrier 10 is filled to its maximum capacity with each post assembly 28 carrying a full stack of six yarn packages, the panel 60 is placed on the end wall 16' to fully cover the opening 25, whereby the uppermost edge of the carrier wall 16 serves as a weir to enable the carrier enclosure 18 to contain treating liquid to a level corresponding with the upper edge of the wall 16 to fully submerge all of the yarn packages and the retaining caps 40 of each post assembly 28, excess treating liquid spilling over the upper edge of the wall 16 as depicted in FIG. 10.

On the other hand, when the carrier 10 is to be filled to a lesser than maximum capacity, the panel 60 will be mounted on the end wall 16' at a lower elevation than in FIG. 10. For example, as shown in FIG. 11, with each post assembly 28 carrying a stack of four yarn packages, the panel 60 is mounted to the end wall 16' in a lowered position by the distance of two of the retaining ears 68. In such position, the panel 60 only partially covers the opening 25, whereby the panel 60 serves as a weir with its uppermost horizontal edge 60' defining the maximum possible level of treating liquid within the carrier enclosure 18 just sufficient to submerge the yarn packages and the retaining caps 40 on each post assembly 28, excess treating liquid spinning over the upper panel edge 60'.

When the carrier 10 is to be filled to its minimum capacity with only three yarn packages mounted on each post assembly 28, the panel 60 is removed altogether (or, alternatively, may be mounted to the end wall 16' in a storage position at the lowest possible position defined by the retaining ears 68), whereby the opening 25 in the end wall 16' is fully uncovered so that its lowermost horizontal edge 25' acts as a weir to define the maximum liquid level possible within the enclosure 18 of the carrier 10, submerging the packages and the retaining caps 40, with excess treating liquid spilling over the edge 25' of the opening 25.

As will thus be understood, carriers in accordance with the present invention advantageously enable the liquid level of the treating bath within a textile package dyeing machine or any other appropriate textile wet treatment machine, to be effectively lowered to the elevation of the actual number of packages supported on the carrier whenever the carrier is loaded to less than its full capacity, without the prior necessity of utilizing any form of blocking element or volumetric displacement element and without the risk of drawing air into the pump of the treatment machine or the risk of potential contamination of the treatment bath. In turn, the costs associated with using an excess of treating liquid and the accompanying environmental problems of reclaiming and/or disposing of used treatment liquid are effectively minimized. While the present invention has been illustrated and described as embodied in a carrier insertable into and removable from a horizontal-type machine, it will be understood that the basic provision of a removable/movable wall panel to achieve a variable level weir may be equally well adapted to liquid containment walls of the type permanently or otherwise fixedly mounted within the vessel of a wet treatment machine and, accordingly, the present invention is not to be limited in application to removable textile package carriers. Likewise, it will be understood that the present invention may be equally adapted to carriers for use in vertical-type machines.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A carrier insertable into a vessel of a wet treatment machine for selectively supporting diverse numbers of annular textile material packages during wet treatment operations, the carrier comprising a base, wall means upstanding from the base and defining therewith an enclosure for retaining treating liquid, and at least one post extending outwardly from the base for mounting a plurality of the textile material packages in series about the post, the wall means comprising a selectively movable panel for forming a liquid weir at a selectively variable level relative to the base to determine a maximum level of liquid which may be retained in the enclosure.

2. A carrier for supporting textile material in a wet treatment machine according to claim 1, wherein the wall means defines an opening therethrough into the enclosure, and mounting means on the wall means adjacent the opening for mounting the panel at varying dispositions for covering the opening to selectively varying extents.

3. A carrier for supporting textile material in a wet treatment machine according to claim 2, wherein the mounting means extends along opposite sides of the opening.

4. A carrier for supporting textile material in a wet treatment machine according to claim 2, wherein the panel and the mounting means respectively comprise matable engaging elements.

5. A carrier for supporting textile material in a wet treatment machine according to claim 4, wherein the matable engaging element of the panel is of a wedge shape and the matable engaging element of the mounting means comprises a bracket tapered in conformity to the wedge shape of the engaging element of the panel.

6. A carrier for supporting textile material in a wet treatment machine according to claim 5, wherein the mounting means comprises a plurality of the brackets arranged at spacings along opposite sides of the opening and the panel comprises a plurality of the wedge shaped elements arranged at corresponding spacings along opposite sides of the panel.

7. A carrier for supporting textile material in a wet treatment machine according to claim 1, wherein the panel is selectively removable from the wall means.

8. A carrier for supporting textile material in a wet treatment machine according to claim 1, and further comprising a package retaining cap mountable to and demountable from the post for selective disposition at differing package retaining positions therealong in engagement with the outermost one of the annular textile material packages supported on the post.

9. A carrier for supporting textile material in a wet treatment machine according to claim 8, wherein the package retaining cap is mountable to the post for lengthwise movement therealong.

10. A carrier for supporting textile material in a wet treatment machine according to claim 8, wherein the post comprises a threaded spindle and the package retaining cap is compatibly threaded.

11. A carrier for supporting textile material in a wet treatment machine according to claim 1 and further comprising a plurality of the posts affixed to the base in spaced parallel relation to one another.

12. A carrier for supporting textile material in a wet treatment machine according to claim 1, and further comprising a package supporting adapter mountable to and demountable from the post, the adapter being of predetermined lengthwise and transverse dimensions for centrally supporting a predetermined number of the annular textile material packages securely on the post.

13. A carrier for supporting textile material in a wet treatment machine according to claim 12, wherein the package supporting adapter and the post are compatibly configured to permit liquid flow axially through the annular interior of the textile material packages.

14. A carrier for supporting textile material in a wet treatment machine according to claim 13, wherein the package supporting adapter includes a sleeve for slidable mounting to and demounting from the post and a plurality of package supporting struts extending radially outwardly from the sleeve.

15. A carrier for supporting textile material in a wet treatment machine according to claim 13, wherein the base includes a liquid flow opening and the post includes an annular mounting portion affixed to the base about the liquid flow opening for liquid communication therethrough with the annular interior of the textile material packages supported on the post.

16. A carrier for supporting textile material in a wet treatment machine according to claim 1, wherein the carrier is configured for horizontal insertion into a horizontal-type wet treatment machine.

17. In combination, a textile wet treatment machine having a vessel, liquid containment wall means disposed within the vessel for defining an enclosure for retaining treating liquid and for defining an opening through the wall means into the enclosure, and means disposed within the enclosure of the wall means for selectively supporting diverse numbers of annular textile material packages during wet treatment operation, panel mounting means on the wall means adjacent the opening, and a panel mounted to the mounting means for selective movement to varying dispositions for covering the opening to selectively varying extents for forming a liquid weir at a selectively variable level to determine a maximum level of liquid which may be retained in the enclosure, the panel and the mounting means respectively comprising matable engaging elements, the matable engaging element of the panel being of a wedge shape and the matable engaging element of the mounting means comprising a bracket tapered in conformity to the wedge shape of the engaging element of the panel.

18. The combination of claim 17, wherein the mounting means extends along opposite sides of the opening.

19. The combination of claim 17, wherein the mounting means comprises a plurality of the brackets arranged at spacings along opposite sides of the opening and the panel comprises a plurality of the wedge shaped elements arranged at corresponding spacings along opposite sides of the panel.

20. The combination of claim 17, wherein the panel is selectively removable from the wall means.

21. The combination of claim 17, wherein the package supporting means includes means for arranging the package in stacks each selectively variable in the number of stacked packages.

22. The combination of claim 17, wherein the machine is a horizontal-type wet treatment machine.

* * * * *